United States Patent [19]

Kuffer

[11] 4,348,937

[45] Sep. 14, 1982

[54] IGNITION ARRANGEMENT FOR AMMUNITION IN A BARREL WEAPON

[75] Inventor: Hans Kuffer, Obertraubling, Fed. Rep. of Germany

[73] Assignee: Rheinmetall GmbH, Dusseldorf, Fed. Rep. of Germany

[21] Appl. No.: 213,575

[22] Filed: Dec. 5, 1980

[30] Foreign Application Priority Data

Dec. 7, 1979 [DE] Fed. Rep. of Germany ..... 2949218

[51] Int. Cl.[3] ..... F41D 11/16

[52] U.S. Cl. ..... 89/24; 89/27 R

[58] Field of Search ..... 89/4 B, 24, 27 R

[56] References Cited

U.S. PATENT DOCUMENTS 4,263,836 4/1981 Koine ..... 89/27 R

*Primary Examiner*—Stephen C. Bentley

[57] ABSTRACT

An ignition arrangement for a barrel weapon having a sliding wedge-type breech block in which a pressure bolt is rotatably mounted in the breech block and the firing pin is slidably movably mounted in the pressure bolt. The firing pin has a transverse rod which extends into a first pair of slots in the pressure bolt and a second pair of longitudinal slots in the breech block. The first pair of slots has a first transverse portion and a second helical portion. The pressure bolt is axially connected to a spiral spring biased control disc which has an actuating cam and a release cam. Coacting cam surfaces are adjustably mounted in the barrel weapon. The opening and closing movements of the breech block cause corresponding rotational movements of the pressure bolt due to the coactions of the actuating or release cams of the control disc with the coacting cam surfaces in the barrel weapon. The rotation of the pressure bolt brings about a retraction or release of the firing pin depending on the coaction of the cam surfaces and cams. The spiral spring acts to propel the firing pin forwardly via the coaction of spiral spring, control disc, pressure bolt, transverse rod, helical slots and longitudinal slots.

7 Claims, 4 Drawing Figures

FIG.3
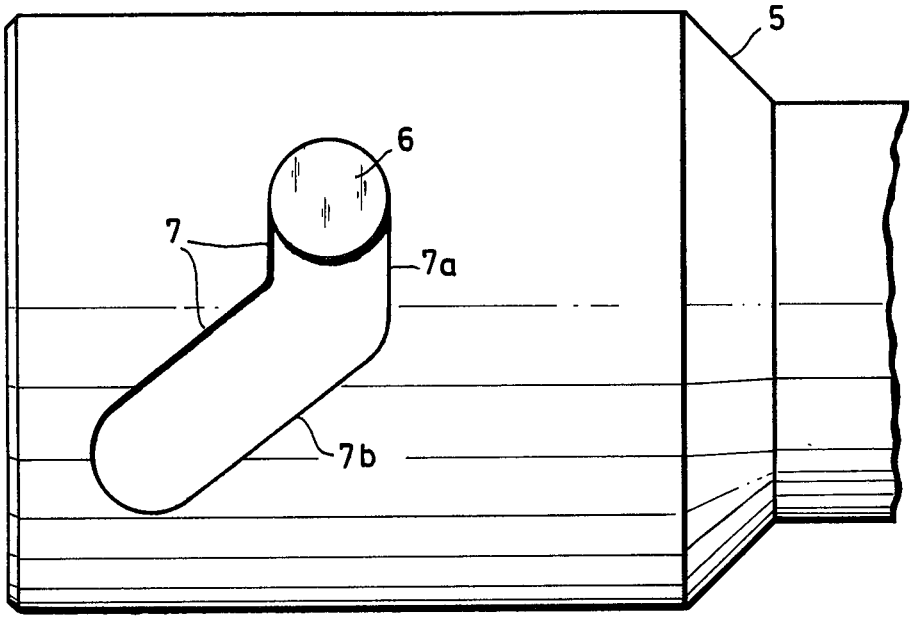
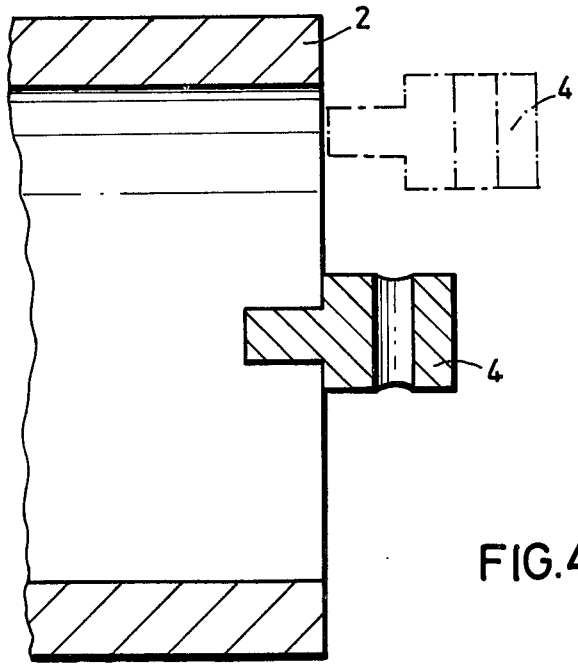
FIG.4

IGNITION ARRANGEMENT FOR AMMUNITION IN A BARREL WEAPON

BACKGROUND OF THE INVENTION

The invention relates to an ammunition ignition arrangement for a barrel weapon of the type having a slidably mounted firing pin in a pressure control bolt, which is slidably displaceable along the longitudinal axis of the barrel. The invention is particularly directed to an automatic barrel weapon utilizing cartridge free ammunition.

Such ignition arrangements are known and are for example disclosed in U.S. Patent Application Ser. No. 050,055 filed on June 19, 1979, entitled SEALING SYSTEM FOR A SLIDING WEDGE-TYPE BREECH BLOCK OF A BARREL WEAPON, now U.S. Pat. No. 4,263,836, and co-assigned to the assignee of the instant invention. The known weapons having installations for cocking and releasing the firing pin independently from the movement of the wedge-type breech block are complex in construction; they require a multitude of individual parts and are therefore subject to malfunctioning in particular during a rapid firing sequence. Their main drawback resides in that the release energy is dependent from the energy of the wedge-type breech block and is not adjustable.

SUMMARY OF THE INVENTION

It is a principal object of this invention to provide a substantially simpler ignition arrangement in such a way that the cocking and release of the firing pin is effected by means of the motion of the wedge-type breech block, whereas the energy of the wedge-type breech block has no influence on the firing pin energy. In particular the invention provides by simple means the possibility to adjust the cadence, that is the firing sequence per unit of time, and provides means for adjusting the release energy. Finally it makes possible a simple safe emergency cocking after a misfiring.

By means of this arrangement there is attained, that when opening the wedge-type breech block, the wedge movement and the movement of the firing pin perpendicularly thereto are superimposed one over the other, so that the firing pin is withdrawn along an oblique line, which provides, that the firing pin, as soon as it arrives in the region of the barrel wall, is completely withdrawn from the barrel. On the other hand, there is assured by means of a release member that the firing pin can be propelled forwardly only then when its axis coincides with the axis of the bore.

The preferred embodiment of the release member in the weapon housing is of such construction, that it is slidable in the direction of the wedge-type breech block movement in the weapon housing and has either an entraining, respectively sliding edge surface, against which the release cam bears during the opening movement of the wedge-type breech block to thereby entrain the release member in the direction of the opening movement. At the end of the wedge-type breech block motion, the release cam slides off the release member as a result of the swinging movement of the control disc, whereafter the release member returns to its initial position as a result of the action of a spring which exerts pressure opposite to the opening direction of the wedge-type breech block. The initial position of the release member can be limited by means of an adjustable stop member. In order to adjust the release moment, in particular in order to advance it for increasing the firing cadence, the stop member is slidably and fixably mounted in the wedge-type breech block movement direction in the weapon housing. By slidably adjusting the position of the stop member there is obtained that the release cam is released earlier in point of time from a stop surface of the release member so that thereby the rotation of the control disc is initiated by the action of the spring force already prior to the termination of the closing motion of the wedge-type breech block.

In order to ensure that the firing pin does not propell forwardly prematurely, there is provided in accordance with the invention, that the guiding slit in the pressure bolt, into which a guide rod of the firing pin projects, is machined into the pressure bolt in the direction perpendicular to its longitudinal axis and this guiding slit also extends in a direction along its longitudinal axis over the surface of the pressure bolt. Due to this arrangement the firing pin can thereby not be propelled forwardly as long as it is not positioned in front of the barrel opening. The angle of the helix of the helically shaped guide slit is determined by the desired firing pin movement.

In order to be able to unload the gun barrel, in the case of a misfiring, there is provided a stop member in the weapon housing in accordance with the invention which is slidable in the direction of the wedge-type breech block and is also fixable in a predetermined position. By sliding the stop member forward, which is preferably carried out hydraulically, the control disc can then be turned by way of the bearing cam and thereby the firing pin can be turned out of the barrel, so that the wedge-type breech block is then opened.

In order to influence the release energy there is moreover provided in accordance with the invention, that the control disc is exchangably mounted, so that it can be exchanged with another control disc having a different mass. The spiral spring can be exchanged for the same purpose, so that it is replaced with a spring having different specifications, in particular having an increased stiffness or rigidity.

BRIEF DESCRIPTION OF THE DRAWING

The above objects, features and advantages of the instant invention, along with other objects, features and advantages, will become apparent upon reading of the following description of a preferred embodiment of the instant invention in conjunction with the drawing, as follows:

FIG. 3 is a schematic plan view of the control pressure bolt illustrating the guide slot, said illustration being at an enlarged scale;

FIG. 4 illustrates the path of the firing pin during the motion of the wedge-type breech block.

DETAILED DESCRIPTION

Figure 1:
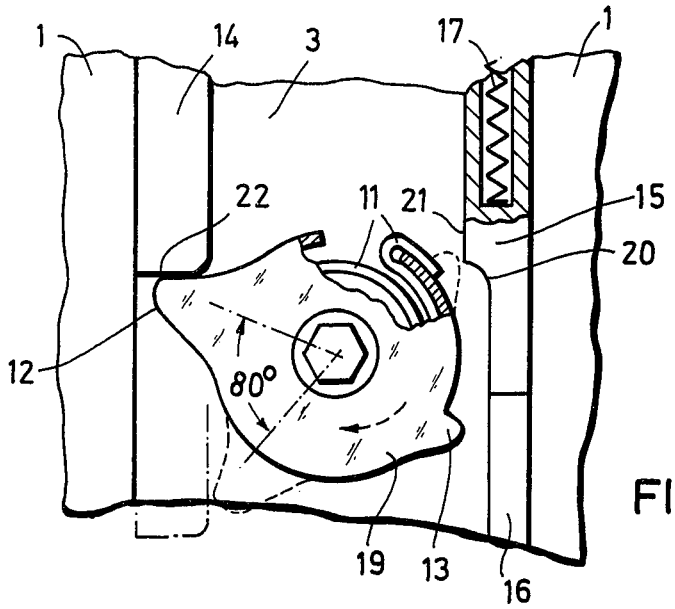
FIG. 1 is a plan view, partially in section, of a wedge-type breech block of the weapon.

The arrangement of the invention includes a weapon housing 1 (FIGS. 1 and 2 of the drawing), a weapon barrel 2, a wedge-type breech block 3, wherein a pin 4 is mounted, and a pressure and control bolt 5. The guide pin or rod 6 engages in the guide slot 7 of the pressure and control bolt 5, which guide pin 6 extends through the firing pin 4. The guide pin 6 engages with its upper and lower end in one of a pair of longitudinal recesses 23 disposed in the wedge-type breech block 3, so that it is longitudinally movable therein. For sealing the opening of the wedge-type breech block 3 there is provided a widening in the gun barrel 2 for accommodating therein an L-shaped sealing ring 9. Additionally, a frusto-conical sealing surface 10 is provided in the wedge-type breech block 3 which engages with mating a frusto-conical surface of the control and pressure bolt 5. The spiral spring 11 is connected with its inner radial end on a square surface of the wedge-type breech block 3. With its outer end the spiral spring 11 is bent over the outer border of the control disc 19 (see FIG. 1), which is connected to the control and pressure bolt 5, by way of engagement of a central hexagonal opening into which a mating hexagonal head 18 of the bolt 5 projects. The control disc 19 has an actuating cam 12 and a release cam 13 approximately radially oppositely disposed of the actuating cam 12. The stop member 14 is adjustably mounted and coacts with the actuating cam 12. A release cam 15 and an adjusting member 16 are adjustably mounted at the other side of the wedge-type breech block 3. A spring 17 is mounted in a recess of adjusting member 16. The entraining, respectively sliding surface 20 and longitudinal edge surface 21 of the release member 15 coact with release cam 13. The holding edge surface 22 is provided on the stop member 14.

Manner of Operation of the Described Ignition Arrangement

Figure 2:
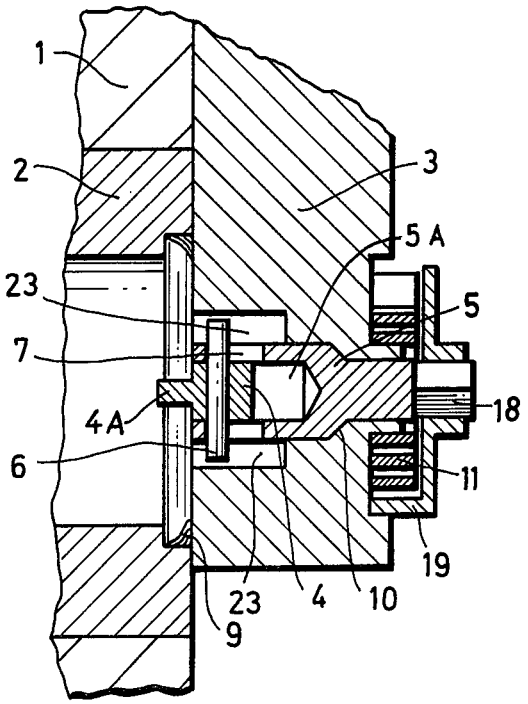
FIG. 2 is a cross-sectional view through the gun barrel and wedge-type breech block along the vertical axial line in FIG. 1.

In FIGS. 1 and 2 there is illustrated the starting position with the wedge-type breech block being in a closed position and wherein the spiral spring 11 is in an uncocked condition. For cocking the spiral spring 11 the wedge-type breech block 3 is moved upwardly between the walls of the weapon housing 1. Thereby the actuating cam 12 of the control disc 19 is brought to bear against the contacting edge 22 of the contacting member 14 until it has swung about 80° into the position illustrated by dotted lines. When this angular position is reached, the release cam 13 also bears against the sliding edge surface 20 of the release member 15 and slides this release piece upwardly against the action of spring 17. During the further opening of the wedge-type breech block the cam 13 then slides along the longitudinal edge surface 21 of the release member 15, which then is again pushed back by the spring 17 into the starting position. By the contacting of the cam 12 against the stop surface 22 of member 14, there is effected a rotation of the control disc 19 towards the left (as seen in FIG. 1) whereby, on the one hand, the spring 11 is cocked and, on the other hand, the firing pin 14 is withdrawn (due to the interengagement of pin 6 and slot 7) in the hollow space 5A of the pressure and control bolt 5, so that its point 4A does no longer project into the interior space of the gun barrel. The pre-cocking of the spiral spring 11 with the contacting member 14 is now maintained.

By means of the downwardly directed closing motion of the wedge-type breech block 3 there results the release for firing. Thereby the release cam 13 of the control disc 19 slides from the longitudinal edge 21 over the sliding edge surface 20 of the release member 15. The spiral spring 11 then rotates the control disc 19 to the right (as indicated in a dashed arrow in FIG. 1) and the firing pin 4 is propelled forwardly, via the guide slit 7 and guide pin 6, into the firing position. Due to the shape and configuration of the guide slit 7, the spiral spring 11 initially rotationally accelerates the control disc 19 while pin 6 still engages the vertical portion **7*a* of the slot 7, without the firing pin 4 moving relative to the control bolt axis. Only after the pin 6 has entered into the helical portion 7*b* of the guide slit 7 is the firing pin 4 propelled forwardly. Thereafter the rotating energy of the control disc 19 is transferred via the control bolt 5 on to the firing pin 4 and from there on to the percussion cap of the ammunition (not illustrated) disposed in the gun barrel 2**.

In order to reduce the time loss and thereby increase the firing cadence, the traversing of the portion **7*a* of the guide slit 7 which is vertical to the axis can already be implemented in the wedge-type breech block closing motion. For this purpose the adjusting member 16** can correspondingly be slid upwardly to such an extent, that a premature release in accordance with the desired firing cadence occurs.

When a misfiring occurs the normal cocking process cannot occur, during which the firing pin is moved into the interior space of the gun barrel over an oblique path, since the cartridge is still there. The firing pin 4 must therefore be retracted, without a corresponding movement of the breech block 3. For this purpose the contacting member 14 is pushed down. Thereby the control disc is rotated about the same angle, about which it is rotated when being cocked by means of the opening movement of the wedge-type breech block 3.

By selecting the specifications for the spiral spring 11 and/or the mass of the utilized control disc 19 the energy there used, which act on the percussion cap, can be changed. They are independent from the energy of the wedge-type breech block 3.

Although the invention is illustrated and described with reference to a plurality of embodiments thereof, it is to be expressly understood that it is in no way limited to the disclosure of such preferred embodiments, but is capable of numerous modifications within the scope of the appended claims.

I claim:

1. An ignition arrangement in a barrel weapon having a sliding wedge-type breech block, comprising in combination, a pressure bolt rotatably mounted in said wedge-type breech block; said pressure bolt having cylindrical walls defining an axial bore in the pressure bolt;

a firing pin coaxially slidably movably mounted in said bore of said pressure bolt;

a control disc coaxially connected to said pressure bolt, said control disc having first and second cams disposed thereon;

first and second cam surface means adjustably mounted in said barrel weapon and adapted to operatively coact with said first and second cams respectively;

biasing means connected to said control disc adapted to move between a biased and unbiased position;

whereby said biasing means bias said control disc in such a way during the opening movement of said wedge-type breech block that said first cam of said control disc is contacted by said first cam surface means and is thereby rotationally biased against the action of said biasing means and the firing pin is retracted from the gun barrel due to the rotation imparted on the pressure bolt by the control disc; whereas during the closing movement of said wedge-type breech block said second cam of said control disc coacts with said second cam surface means to retain said control disc in a predetermined angular position until the axis of the firing pin coincides with the axis of the gun barrel, so that only then the biasing means are fully released to move their unbiased position and thereby propel the firing pin forwardly into the barrel of the weapon.

2. The ignition arrangement in a barrel weapon as set forth in claim 1, wherein said second cam surface means forms part of a release cam which is slidably movably mounted in said barrel weapon in the direction of movement of said wedge-type breech block, and a spring connected to said release cam and biasing it in the breech block movement direction, said release cam having an entraining surface and a gliding surface, said second cam contacting said entraining surface during the opening movement of the wedge-type breech block to cause it to move with the breech block and slides off the entraining surface at the end of the opening movement, whereafter said release cam is returned by the action of the spring to its initial position.

3. The ignition arrangement in a barrel weapon as set forth in claim 2, including a stop member adjustably mounted in said barrel weapon and adapted to coact with said release cam to limit its movement and adjust the timing of the sliding off of the second cam.

4. The ignition arrangement in a barrel weapon as set forth in claim 1, wherein a rod is transversely mounted in said firing pin, said cylindrical walls in said pressure bolt having a first pair of oppositely disposed slots, said wedge type breech block having a second pair of longitudinally extending slots, opposite ends of said transverse rod extend into said slots of said pairs of first and second slots, said first pair of slots having a first portion extending along a plane which is perpendicular to the longitudinal axis of the pressure bolt and a second portion which extends helically along the surface of the pressure bolt.

5. The ignition arrangement in a barrel weapon as set forth in claim 4, wherein said first cam surface means is in the form of a stop member which is slidably adjustably movably and fixably mounted in said barrel weapon in the direction of movement of said wedge-type breech block.

6. The ignition arrangement in a barrel weapon as set forth in claim 1, wherein said control disc is removably connected to said pressure bolt so that it may be disconnected and exchanged for control disc of different mass.

7. The ignition arrangement in a barrel weapon as set forth in claim 1, wherein said biasing means are in the form of a spiral spring mounted around said pressure bolt and removably connected to it as well as to said control disc, so that said spiral spring may be disconnected and exchanged for a spiral spring of different stiffness.

* * * * *